United States Patent [19]

Meyer

[11] Patent Number: 5,044,654

[45] Date of Patent: Sep. 3, 1991

[54] PLATE RELEASE BINDING WINTER SPORTS DEVICE

[76] Inventor: Urs P. Meyer, In der Rehweid 2, CH-8122 Pfaffhausen, Switzerland

[21] Appl. No.: 519,152

[22] Filed: May 4, 1990

[30] Foreign Application Priority Data

May 4, 1989 [CH] Switzerland ..... 1675/89

[51] Int. Cl.[5] ..... A63C 9/08

[52] U.S. Cl. ..... 280/613; 280/618; 280/14.2

[58] Field of Search ..... 280/607, 613, 617, 618, 280/14.2, 611

[56] References Cited

U.S. PATENT DOCUMENTS

| | | | |
|---|---|---|---|
| 3,902,729 | 9/1975 | Druss | 280/613 |
| 4,191,395 | 3/1980 | Salomon | 280/613 |
| 4,310,170 | 1/1982 | Linecker | 280/607 X |
| 4,741,550 | 5/1988 | Dennis | 280/14.2 X |

FOREIGN PATENT DOCUMENTS

| | | | |
|---|---|---|---|
| 2604913 | 4/1988 | France | 280/14.2 |

*Primary Examiner*—Andres Kashnikow
*Assistant Examiner*—Michael Mar
*Attorney, Agent, or Firm*—Laurence R. Brown

[57] ABSTRACT

The plate release binding for winter sports devices comprises a mobile binding plate (1) of oblong basic outline with a widened mid-section and a vertical central bore (28). The entire engagement and disengagement mechanism, mainly comprising pressure springs (12) and pressure pistons (13) is built into the compact plate into a minimum of space below the area of the boot sole. The binding plate is engaged with the fixed mounted hub (2) on the snowboard by a downward and turning movement of the foot. The hub acts as the only anchoring device for each binding and at the same time also as the central rotational, pivotal and guiding axis for the multidirectionally turning , tilting and lifting movements of the plate.

9 Claims, 5 Drawing Sheets

PLATE RELEASE BINDING WINTER SPORTS DEVICE

BACKGROUND OF THE INVENTION

1. Field of the Invention

The present invention broadly relates to a plate release binding for Winter sports devices, in particular for snowboards, but suitable also for skis and related devices, equipped with a mobile plate having attachment means for a boot and a coupling mechanism connectable with an anchoring device, attachable on the snowboard, and detachable from it before injury-inducing forces are reached.

In spite of the fact that especially in the still fairly new sport of snowboarding many injuries resulting from crashes involving mainly feet and legs do occur, because the generally young riders' preference for daring manoeuvres and today's longer and faster boards, there is still no safety release binding for snowboards on the market which liberates the foot in case of excessive torsional and pivotal forces in all directions, and which also meets the safety codes of such authorities as the German TüV, the Swiss BFU or equivalent institutes.

2. Description of the Prior Art

Most present snowboards are equipped with so-called soft or buckle bindings, which require the use of mountaineering or after-ski boots. But the so-called plate bindings usable with ski or ski touring boots having standardized sole extensions are becoming increasingly popular. Both of these types of bindings are firmly attached to the snowboard and will not release the feet in case of a fall. Due to the fact that snowboards are generally thinner than skis, only relatively short screws of low extraction resistance can be used for mounting the binding. As a result of the practically rigid binding attachment and the foot position across the board, extremely high screw extraction forces occur even during normal use, resulting especially from the lateral pivoting movement of the foot. Thus, it happens quite often that the bindings are ripped off the board under normal use, or sole attachments may break. Such events are seriously feared by riders, because grave injuries may result from the typical forward twisting falls with only one single foot still attached cross-wise to the snowboard. The falling rider can hardly count upon the second binding to rip off too and thus reduce the risk of injury, because screw connections cannot withstand the high torsional forces that are likely to occur in such cases.

There are various reasons why there are no safety bindings with all-directional release and with the approval of the leading safety authorities on the market as yet. In any case, today's conventional ski bindings with separate front and heel piece cannot be used on snowboards, because they extend too far beyond the boot sole ends, so that they would drag in the snow, and because they do not feature any lateral pivoting release. The development of totally new binding systems, as would be required here, is technically a difficult task, and also very complicated and costly. In view of the still relatively small snowboard market, the leading ski binding manufacturers regard such a venture as too risky at the moment. On one hand, the binding should not negatively influence the elasticity and the flex curve of the snowboard and, on the other hand, the functioning of the binding should not suffer from the flexing action of the very elastic snowboards, as would be the case if conventional ski bindings were used.

The only snowboard plate release binding on the market at this time is the one under the brand name "Fuzzy". It was designed especially for the so-called Snow-Surfer, a device with two ski-type runners mounted underneath an articulated, elevated platform, on which the feet are placed when riding. However, this binding offers only lateral pivoting and lifting releases, and it lacks the most important Lorsional release. This is why it will not be approved by the TüV.

Inspite of their non-existing release features, most snowboard bindings are of quite complicated design, and their mounting requires in many cases the drilling of up to 40 holes in the snowboard. On account of the fact that these holes are located exactly in the area of highest stress forces, a substantial reduction of the boards' breaking strength is usually the case. Additional screw holes are required in the board if the foot angle has to be adjustable or if the binding has to be turned from the "regular" to the "goofy" foot position, and this further reduces the breaking strength.

Most snowboard bindings are very high, especially the buckle bindings, for which reason boards with such bindings use up so much room that they are difficult to store and to transport. It is also very costly for owners of several boards having to buy separate bindings for each one.

SUMMARY OF THE INVENTION

Therefore, with the foregoing in mind, it is a primary object of the present invention to provide a binding without any of the aforementioned disadvantages of the binding systems generally used today especially for snowboards, but also for skis and ski-like devices, by assuring general safety to the user through all-directional torsion, pivot and lift release functions, by increasing the entry and exit comfort and by featuring an easier individual binding adjustment. These problems are solved by the measures defined with more particularity in the claims.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have generally used the same reference characters to denote the same or analogous components and wherein.

DETAILED DESCRIPTION OF THE PREFERRED EMBODIMENT

Figure 1:
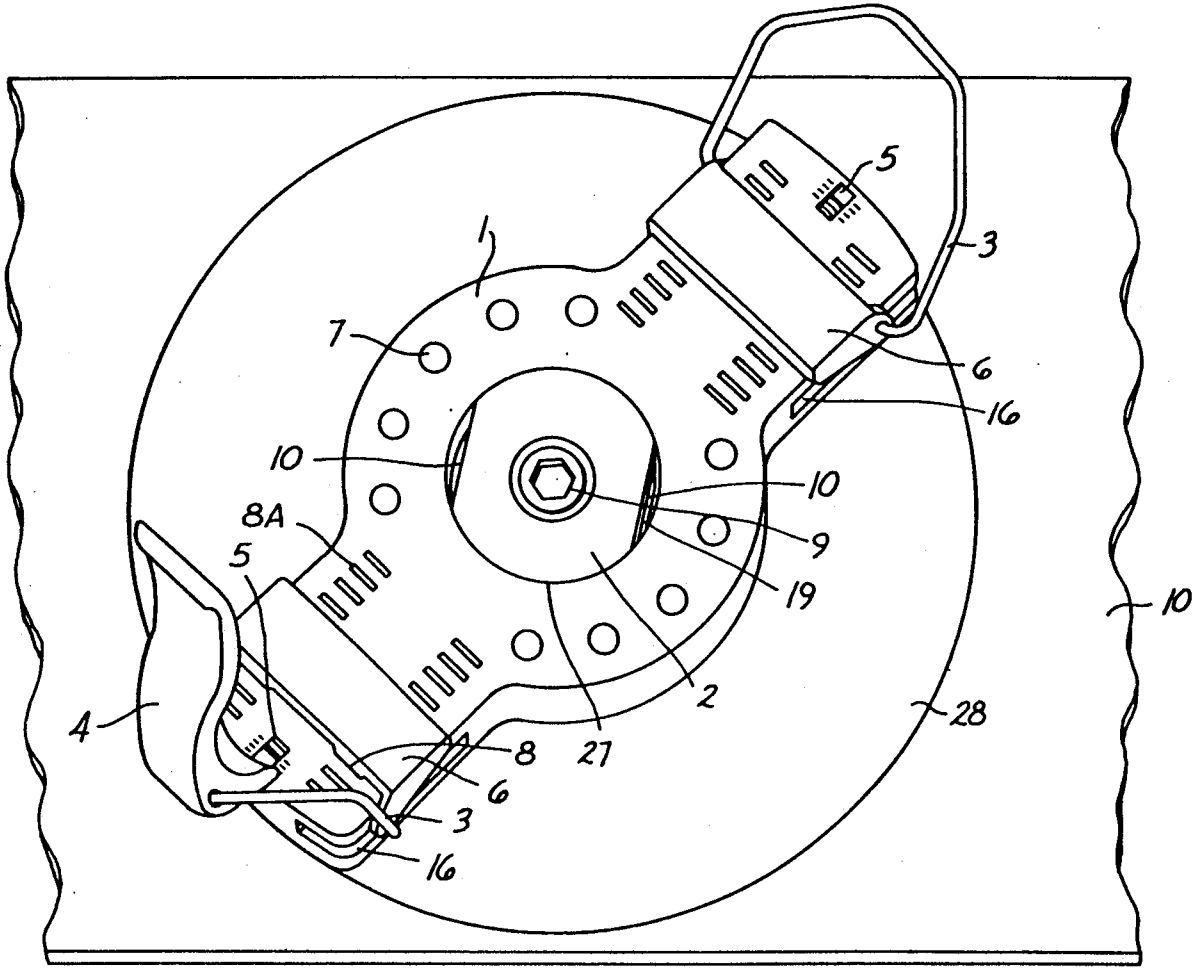
FIG. 1 shows a general view of the binding at an angle from above.

The preferred embodiment of the invention, as illustrated in the drawings, has proven to function well in practice. For weight and cost reasons the mobile plate 1 and the closing lever 4 are made of injection-molded plastic material, preferrably polyamide. The hub 2 may also be made of high-quality plastic material. However, due to the high mechanical stresses, to which it will be subjected, a metallic material is preferred for this part. The sole attachment bails 3 are preferrably made from spring steel wire, as are the pressure springs 12. All screws 9, 11 and 17, as well as the washer 16, the base plate 14 and the U-shaped profile 6 are preferrably made of metallic materials.

Figure 4:
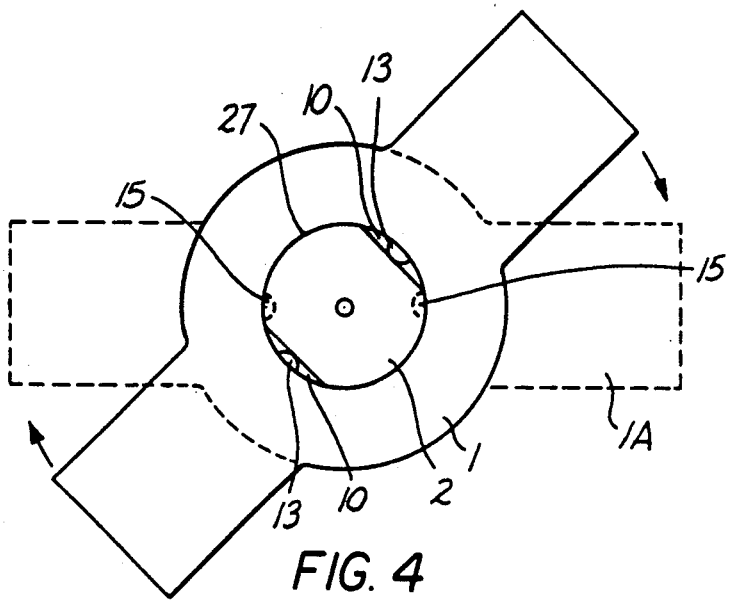
FIG. 4 shows the principle succession of movements necessary for the engagement of the binding.

The mounting of one single, compact hub 2 per binding on the center-line of the device 10 is clearly simpler and less time consuming than the mounting procedure of any other presently existing release or non-release type binding. At the beginning, six screw holes, arranged around a circle, have to be drilled into the device at the intended binding center. Thereafter, the anti-friction plate 28 and the base plate 14, positioned directly above the latter, are firmly mounted by means of six screws 17, which pass through the holes 26 in the base plate 14. The hub 2 may be attached by means of one single central bolt 9 and an accompanying washer 16 to the thread 21 in the center of the base plate 14. Identically sized, fine radially arranged teeth 20 on the base plate and underneath the hub lock the hub in the desired angle on the device in relation to its center-line and prevent unintentional rotation under high torsional loading. The hub is preferably shaped in the form of a round disk at the periphery of which there are recesses 15, located in opposite positions in which the tips of the pistons 13 are anchored, when the binding is engaged. The flat sections 10 with horizontal guiding grooves 19, which are placed next to the recesses facilitate the entry and engagement of the binding plate 1. As shown in FIG. 4, the plate 1 is lowered prior to engagement in such a radially off-set position, where the pistons 13 are positioned near the flat sections 10 of the hub 2, against which there is no resistance. Thereafter, the plate only has to be turned until it engages in the position 1A, as shown in FIG. 4. The plate cannot deviate upwards while being turned, because the pistons are guided by the grooves 19 during this operation. The resistance being felt by the user during the engagement by rotational movement is also a helpful indication concerning the release setting, due to the fact that the pressure spring 12 has to be compressed during this operation. For changing the binding angle in relation to the snowboard's centerline, the user only has to loosen the central bolt 9 somewhat until the radial teeth are not locked against each other anymore, turn the plate to the desired angle and re-tighten the central bolt firmly. The binding plate 1 does not even have to be removed for this.

Figure 3:
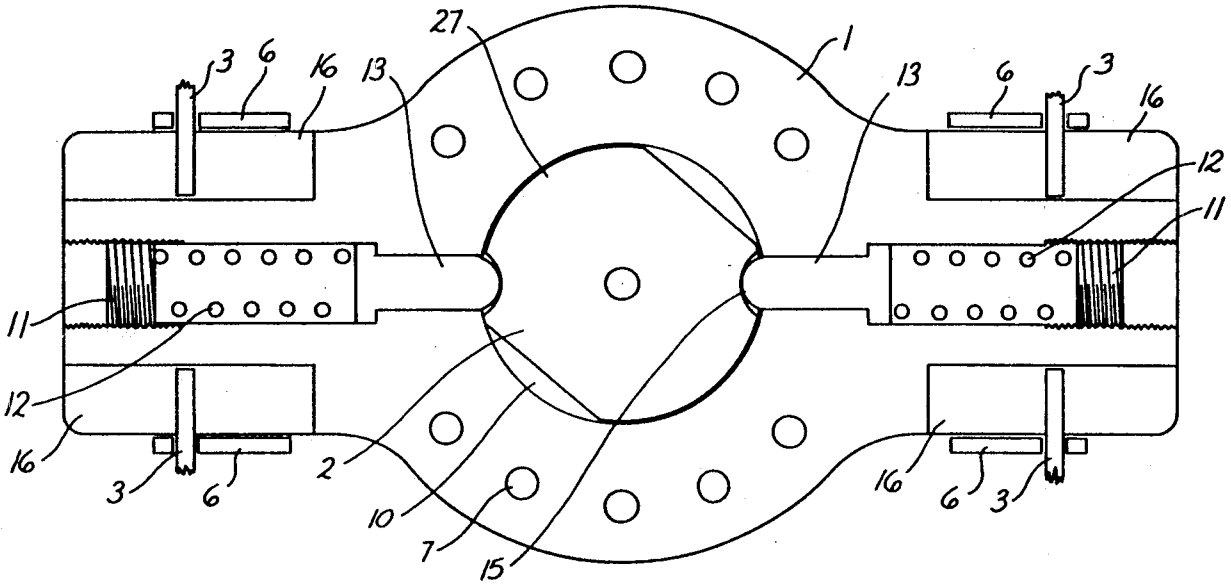
FIG. 3 shows a horizontal section.
Figure 5:
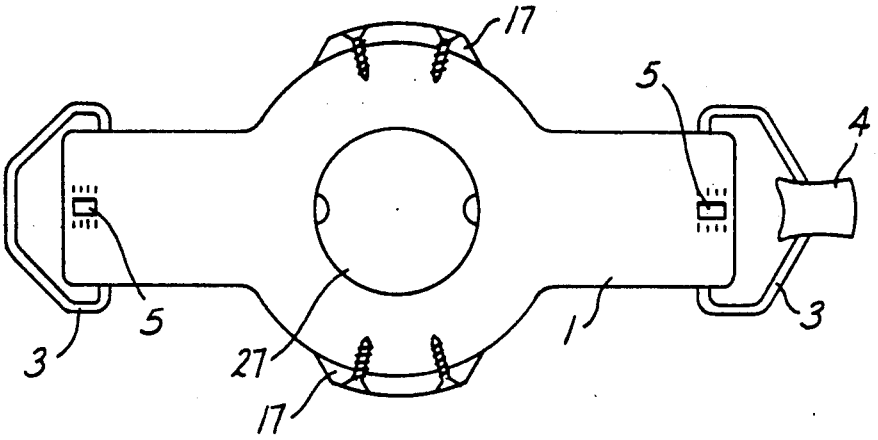
FIG. 5 shows a top view of a special version with variable geometry.

The basic outline shape of the mobile binding plate 1, as shown in FIG. 1 and 3, has proven to function well in practice. At minimum height, it offers a very favorable strength-to-weight ratio. The widened mid-section serves the purpose of increasing the breaking strength and stiffness in these zones of highest stress in the middle, as well as a larger base support of the plate on the snowboard, whereby the lateral pivot center is moved further towards the outside from the central anchoring area. This distance between the central anchoring center and the lateral pivot center decidedly influences the all-important relationship between torsional and lateral pivoting release. The version of the plate 1, shown in FIG. 5, can be further widened by means of additional widening elements 17, which are attached to the sides of the plate by means of screws, whereby the lateral pivot release force increases in relation to the torsional release, if so desired. Another possible solution for altering the ratio between torsional and pivotal release would be an adjustment of the plate width by means of a fine adjustment screw mechanism, of which there is no illustration.

Figure 6:
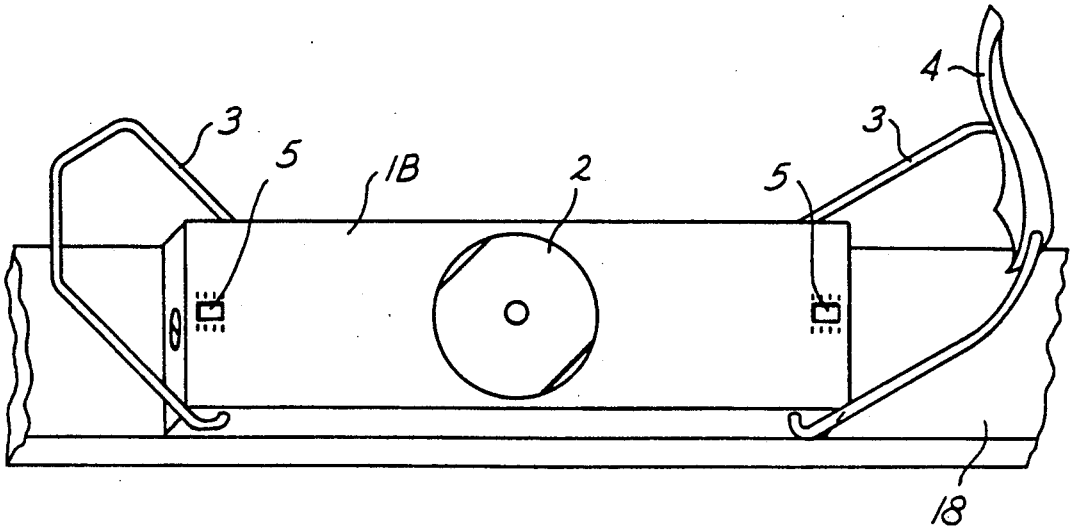
FIG. 6 shows a view of a version suitable for skis.
Figure 7:
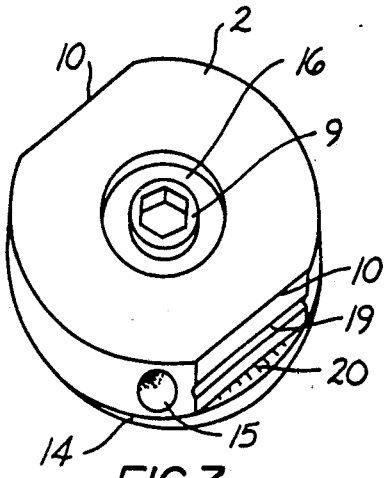
FIG. 7 shows a view of the hub.
Figure 10:
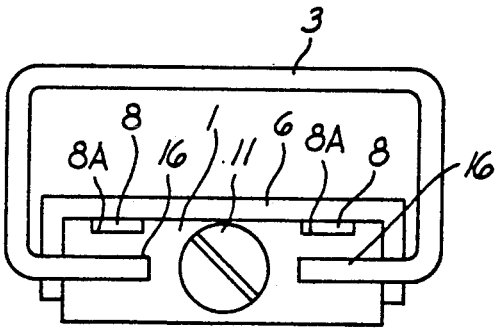
FIG. 10 shows a cross-section through one of the plate ends.

In the embodiment intended for skis, as shown in FIG. 6, the plate does not require a widened central section, because ski bindings do not need pivotal releases and furthermore, the widened part of the plate would scrape the snow while turning hard or traversing a steep incline. The necessary reinforcement of the plate's center section can be accomplished by other means, such as preferrably by a modification of the shape and a different material distribution within the plate.

Figure 2:
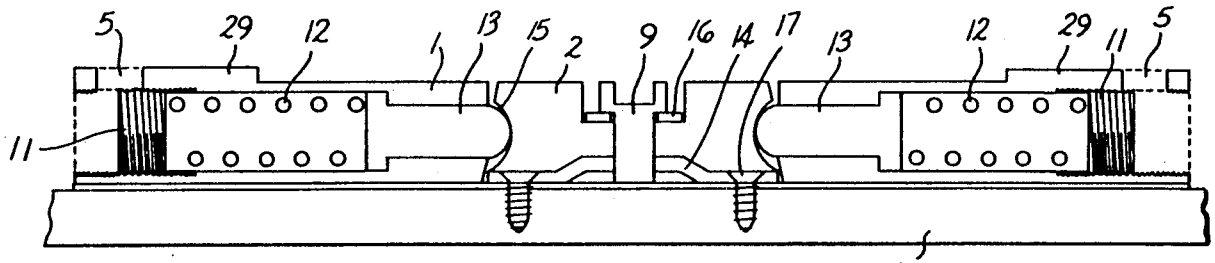
FIG. 2 shows a vertical longitudinal section along the center line.

An equally low height, as illustrated in FIG. 2 with hub 2 and plate 1, is desirable, because the higher the foot position over the snow, the lower the control. Nevertheless, slightly increased sole support plates 29, which place the boot sole clearly above the the top rim of the central bore 27, are an advantage, because this permits a better evacuation of snow stuck in the central bore during the engagement of the binding plate. This allows the snow to be pressed out through the space between the top of the binding plate and the boot sole.

In simpler versions of the inventive binding, the sole attachment bails 3 could be screwed into the sides of the plate, as is the case with the Swiss Fritschi bindings. An adjustment of the sole length that does not require any tools, as shown in FIG. 1 and and 3, is desirable. The solution shown here is economic, fool-proof and sturdy.

For the adjustment of the sole attachment bail 3, one only has to lift the inverted U-shaped profile 6, thereby releasing the teeth 8 from the recesses 8A. Now, the sole attachment bails can be moved together with the U-shaped profile to the desired position on the plate, and by lowering the latter, the teeth engage firmly again. On account of the fact that the boot sole applies a downward pressure onto the U-shaped profile, it is virtually impossible for the sole attachment hail to slip to another position unintentionally during use. Nevertheless, it is recommended to provide the U-shaped profile with a sprung snap-in catch in order to prevent the sole attachment bail to become loose during transport or the like. The raised, flat top of the U-shaped profile serves also as the raised boot sole platform 29. The horizontal ends of the sole attachment bails 3 are movably attached in horizontal slots 16 along both parallel end sections of the plate. Directly at the outer rim of these slots, the bail ends pass through holes in the side flanges of the inverted U-shaped profiles. The bails not only serve the U-shaped profile as hinging point, but also as its attachment.

The diameter distribution of the vertical central bore 27 of the plate 1 has to be adapted to the diameter distribution of the hub 2 in such a way that the hub locates the plate in the engaged state without any radial play, but will not hinder its movement during pivoting release. Preferrably, this is achieved by decreasing the diameter of the hub from bottom to top and by increasing the diameter of the vertical central bore of the plate. If these conical diameter changes start from mid-height, a connection without any radial play between hub and plate is the result.

Both of the two opposing pistons 13, as well as the accompanying pressure springs 12 and pressure adjustment screws 11 are built into the plate along its longitudinal central axis, entirely underneath the outline of the boot sole, using a minimum of space in a well-protected and water-proof enclosure. The thread for the pressure adjustment screw goes only to a depth where the spring cannot be locked up in use. The pressure springs 12, adjustment screws 11 and adjustment windows 5 with indication marks for release settings are in such a calibrated relationship with each other that the rear edge of the adjustment screw remains in the area of the adjustment window over the normal range of adjustments.

Binding versions intended for light-weight users, such as children, could be equipped with only one single pressure spring cylinder, which would minimize weight and cost. Such a simplified type of binding is not especially illustrated in any of the drawings.

The holes 7 arranged around a circle in the plate 1 could be used to mount the binding plate firmly to the snowboard the same way as is the case with most other existing plate bindings. Such a non-releasing configuration of the binding might be of advantage for special applications, such as for extreme freestyle manoeuvres on very short snowboards, on which accidents are less likely to occur, because of their short levers. The same holes 7 can also be used for the attachment of the buckle-binding 23 on the plate for the use with after-ski boots 22 in place of the sole attachment bails. These holes also help to reduce unnecessary dead weight.

A further possibility to produce a rigid, non-releasing connection between the plate 1 and the device 10 is accomplished by replacing the pressure springs 12 by rigid cylinders, which are not shown in any of the drawings. With these, tightening of the adjustment screws will rigidly press the pistons 13 into the recesses 15 of the hub 2 and, because any spring action is thereby eliminated, the plate is firmly held to the snowboard in a non-releasing mode.

Figure 11:
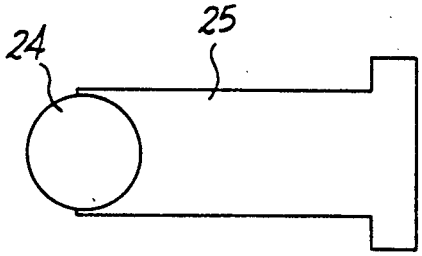
FIG. 11 shows a pressure piston with a rotating ball at its tip.
Figure 9:
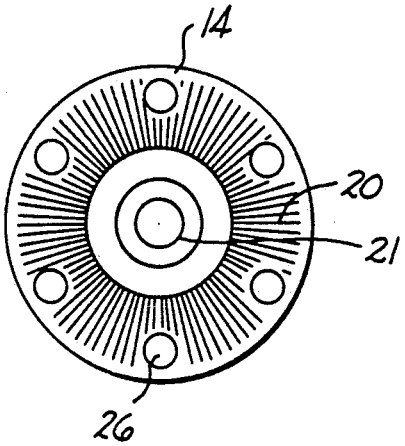
FIG. 9 shows a view of the base plate of the hub.
Figure 12:
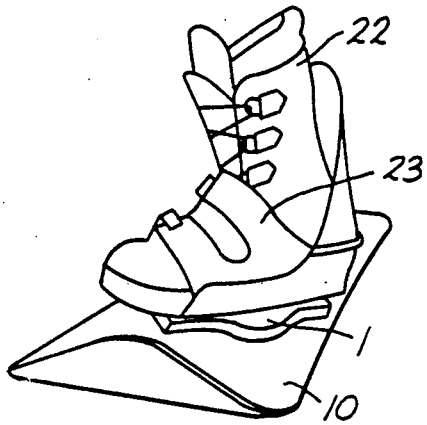
FIG. 12 shows a view of the binding with a buckle binding attached.

FIG. 11 shows a preferred version of the piston with a rotating ball of resistent material at its tip. The supporting rear section 25 holds the ball slightly beyond its circumference of largest diameter, thereby preventing it from falling out of its support, as is common practice with ball-point-pens. The rotating ball reduces the coefficient of friction drastically.

Figure 8:
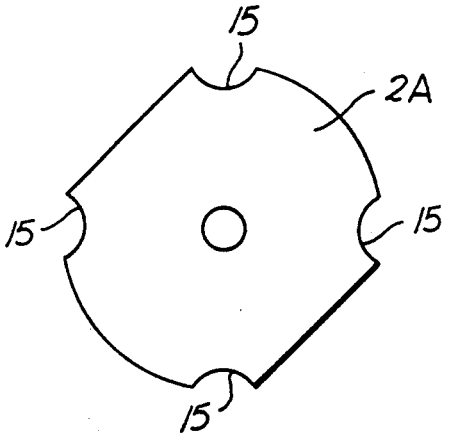
FIG. 8 shows a horizontal section through the hub at mid-height.

FIG. 8 shows the horizontal cross-section at mid-height of an embodiment of the hub 2A with two separate pairs of recesses 15, arranged cross-wise. This allows the plate to be anchored either in the "regular" or the "goofy" position without having to change the position of the hub on the snowboard.

Figure 13:
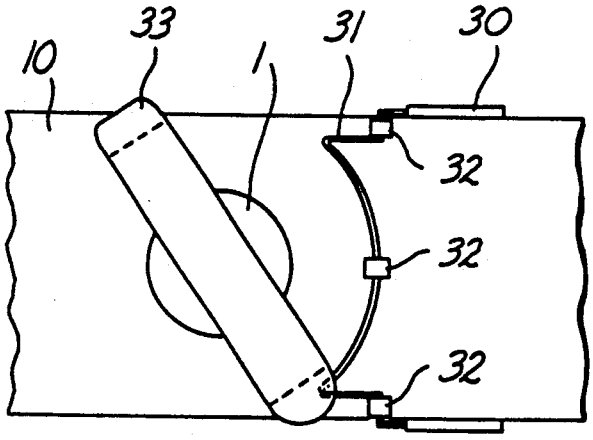
FIG. 13 shows a fragmented plan view of an embodiment with an automatic braking device.
Figure 14:
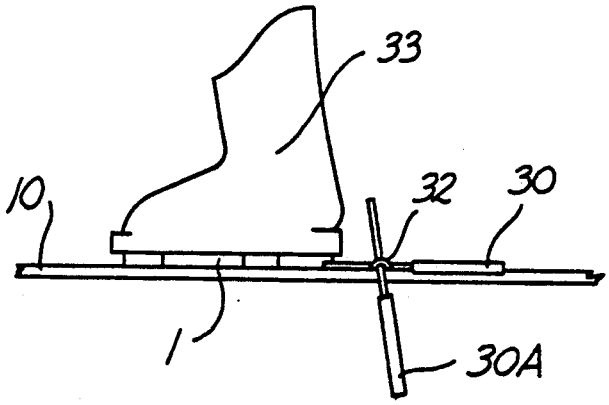
FIG. 14 shows the braking device in side view.

FIG. 13 and 14 show a schematic drawing of a preferred embodiment of the automatic braking device with two-sided brake levers 30, brake bail 31, brake attachments 32, a schematic drawing of the binding plate 1 with boot 33 mounted on the device 10. It can be seen here that the brake bail is pressed to the horizontal position by the heel of the attached boot, thereby lifting the brake lever above the top of the snowboard, where it will not touch the snow. The brake bail is spring-loaded in such a way that in a free state or, in other words, when the plate and boot are disengaged, the brake levers will move to position 30 A, in which the ends of the levers reach below the level of the snowboard base and cause the snowboard to stop immediately by dragging in the snow. The illustrated version of the brake bail 31 is of a semi-circular shape, the center of which lies in the middle of the accompanying binding. This shape of the brake bail allows the plate 1 to be set in either the "regular" or "goofy" mode without having to change the brake adjustment. Furthermore, this shape of bail enables the user to engage the plate without having to bend down and lift the brake levers manually. This is accomplished by lowering the foot over the hub 2 about parallel to the longitudinal axis of the snowboard, in which position the boot sole is already above the brake bail 31. While turning the plate with the foot for engagement, the brake bail is automatically pressed down flat. Instead of the automatic, shoe-activated brake, as shown, a semi-automatic version is also possible, which is brought to the non-braking position and engaged there manually. For this brake, the user attaches a leash to his leg, the outer end of which is connected to a brake retaining device. During a fall, the brake retaining device is disconnected by the pull of the leash, and the brake instantly moves to the braking position. A brake version of such a type could be built in a more compact way. The necessary spring loading for the activation may either be provided by tension, pressure or spiral springs, none of which are shown expressely in the drawings. An integral torsion spring action of the brake bail, as is often used in ski brakes, is preferred. Such an integral torsional spring loading can function in such a way that for instance the middle of the three brake bail attachments 32 is mounted somewhat further forward on the snowboard 10 than the other two attachments on either side. At the same time, the brake bail is shaped in such a way that the brake levers are pointed approximately, vertically downward in their braking position. When the brake bail is pressed down flat, the bail made from spring steel wire is internally loaded. As a result thereof, it will immediately return to the braking position whenever it is released.

Numerous test rides, in which also well-known Worldcup riders have participated, have furnished sufficient proof that the inventive plate release binding for winter sports devices, as described herein, functions perfectly. The feet are always released instantly from the snowboard in all types of conventional and unconventional falls, so that no injuries whatsoever occured throughout testing. Even riders that were doubtful at the beginning and did not really believe in release bindings for snowboards, changed their minds and were convinced. The testers praised especially the simple, fool-proof construction, which is actually more compact and of lighter weight than some non-releasing snowboard bindings. The recommendation that the user is best advised to adjust the binding himself to his own requirements and test it statically by twisting and tilting his foot until release occurs was judged favorably because of its good results. Due to the fact that in case of dangerous falls both bindings always released within fractions of a second, all testing persons were convinced that an inter-active, simultaneous release system, as often demanded in the past, is neither necessary nor desirable any more. They would only be complicated and presumably unreliable. The user-friendliness and safety are greatest with the use of a brake-mechanism. Thus, it is possible for example to approach towards the loading platform of a ski or chair lift with the rear foot removed, and upon arriving at the top unloading platform, the rear foot can be re-engaged on the snowboard without having to bend down.

Because of the added safety of these bindings, a further barrier against snowboards will fall and inspire the market to further growth. Sporting goods dealers will not have to worry about liability claims from injured clients using non-releasable bindings anymore, and parents can now buy snowboards with greater confidence for their children, since they are available with safety release plate bindings.

Owners of several snowboards, who until now, had to spend a lot of money to equip all their boards with separate bindings, can now save money by having to purchase only one complete pair of bindings for all their boards. The extra boards need only separate base plates and screws, which cost very little. Thus, he now gets safety and comfort at a lower price than what he would have to pay for today's conventional equipment without these features. With disengaged binding plates or entirely removed bindings, several snowboards can be stacked flat on top of each other for easy storage and transportation. This way, up to 6 snowboards with the necessary base plates mounted will easily fit into a single board bag, whereas only one board with conventional buckle bindings will fit into a similar bag. This advantage will be well appreciated especially by racers, who usually travel around with several boards.

Because of the central attachment of the plate on the snowboard, there is never any adverse shear or other force induced by stiff boot soles or split binding plates. Not only as a result of this, mounting screws are not as highly stressed, but also because release takes place before any forces will exceed the screw extraction limit. Should one of the bindings still rip off due to unknown reasons, the other one will always release the remaining foot in the subsequent fall, thereby preventing any danger of injury to the leg.

With the additional safety provided by these bindings, their users will be able to execute even more daring manoeuvers with less risk of injury than before. This too will provide an additional big input to the sport of snowboarding.

What is claimed is:

1. A plate release system for a pair of bindings that releasably secures the boots of a snowboard rider to a snowboard and for automatically releasing the boots from the snowboard upon a predetermined force being exceeded on said boots, each one of said pair of bindings comprising:

a base plate adapted to be fixedly mounted to the upper surface of the snowboard, a hub adapted to overlie said base plate, an anchor bolt extending through the center of said base plate and said hub, each of said base plate and said hub having radially extending teeth which are adapted to overly in mating relationship to define a plurality of angular positions of rotation of said hub about a vertical axis of said base plate, said anchor bolt being adapted to lock said hub to said base plate in a selected one of said angular positions, a rotatable plate adapted to be attached to the sole of the boot, said plate having a central vertical bore for rotatably receiving said hub, and connection means for releasably coupling said plate to said hub, said connection means including at least one spring-biased pressure piston located in said plate, said piston having a tip portion extending into said central bore and recesses located along a radial periphery of said hub for selectively receiving said piston, whereby said connection means releases said plate from said hub in response to said predetermined force.

2. A plate release binding, as defined in claim 1, for snowboards wherein said plate comprises a widened center section, said center section exceeding in width a boot sole width.

3. A plate release binding, as defined in claim 1, wherein the hub has segment-shaped, flat sections next to the recesses at its periphery.

4. A plate release binding, as defined in claim 3, wherein the rotatable plate comprises two separate pressure springs and two separate pressure pistons, said pressure springs and pressure pistons being placed along a longitudinal axis of the rotatable plate in opposing directions positioned for mating in said recesses.

5. A plate release binding, as defined in claim 4, wherein said pressure pistons comprise a freely rotating ball of friction and pressure resistant material.

6. A plate release binding for snowboards, as defined in claim 1, wherein the rotatable plate has an adjustable width.

7. A plate release binding, as defined in claim 1, wherein the rotatable plate is equipped with boot attachment means suitable for ski-boots with standardized sole ends.

8. A plate release binding, as defined in claim 1, comprising sole attachment bails for ski-boots with standardized sole ends, side-flanges on said plate having horizontal slots in which two ends of sole attachment bails are movably held, inverted U-shaped profile means closely fitting over sides of the plate and having at least one tooth slot located on the top side of the plate for receiving said tooth thereby to adjust said bail to fit various boot sole lengths, and means for lifting and moving the U-shaped profile to lock it in place.

9. A plate release binding, as defined in claim 1, for snowboards, wherein an underside of the rotatable plate is beveled on at least one side from the center-line towards the outside, such that the cross-section of the underside of the plate has the shape of a flat V permitting the plate to rock laterally within a limited range, thus providing a more comfortable stance to the rider.

* * * * *